United States Patent [19]

Eaton

[11] Patent Number: 4,946,038

[45] Date of Patent: Aug. 7, 1990

[54] MEDICINE CONTAINER AND COVER THEREFOR

[76] Inventor: Rolland Eaton, 16 N. Dutoit St., Dayton, Ohio 45402

[21] Appl. No.: 453,934

[22] Filed: Dec. 20, 1989

[51] Int. Cl.[5] ..... B65D 83/04

[52] U.S. Cl. ..... 206/528; 206/613; 206/813; 206/807; 53/396; 53/410; 53/412; 53/449

[58] Field of Search ..... 206/528, 529, 530, 531, 206/532, 534, 534.1, 534.2, 535, 536, 537, 538, 539, 533, 540, 807, 613, 813; 53/396, 410, 412, 449

[56] References Cited

U.S. PATENT DOCUMENTS

| | | | |
|---|---|---|---|
| 2,343,222 | 2/1944 | Nelson | 206/613 X |
| 3,495,759 | 2/1970 | Bergstrom et al. | 206/613 X |
| 3,630,346 | 12/1971 | Burnside | 206/534 X |
| 3,835,995 | 9/1974 | Haines | 206/536 |
| 3,844,408 | 10/1974 | Relyea | 206/534 |
| 4,002,239 | 1/1977 | Buchalter | 206/813 X |
| 4,280,621 | 7/1981 | Tonrey | 206/534 |
| 4,319,684 | 3/1982 | Backman et al. | 53/396 X |
| 4,416,375 | 11/1983 | Braveman et al. | 206/534.1 |
| 4,538,651 | 9/1985 | Lylins | 53/396 X |
| 4,860,899 | 8/1989 | McKee | 206/534 |

FOREIGN PATENT DOCUMENTS

| | | | |
|---|---|---|---|
| 2327206 | 12/1974 | Fed. Rep. of Germany | 206/530 |

*Primary Examiner*—William I. Price

*Attorney, Agent, or Firm*—Jacox & Merkstroth

[57] ABSTRACT

A medicine container and cover therefor. The medicine container has side walls which have wave portions. The medicine container also having end walls which are angular with respect to the side walls. Therefore, the medicine container can be easily and readily grasped for retaining the medicine container for dispensing the contents of the container. The medicine container also has a flange which extends from the walls. The cover is attached to the flange. The cover has tab portions which extend from the flange and which can be grasped for easy opening of the medicine container to dispense the contents of the medicine container.

26 Claims, 2 Drawing Sheets

42
42L
52
48
52a
58
60
52c
52b
48L
2
40
30
20
30a
4
16
26
16a
30b
12
22
76
64
72
78

MEDICINE CONTAINER AND COVER THEREFOR

BACKGROUND OF THE INVENTION

Small disposable containers are employed to contain medicines which are in the form of pills, capsules and the like. Such a container is shown in U.S. Pat. No. 4,860,899. Customarily, such disposable containers are of rigid material and are relatively small in physical size due to the fact that the pills and/or capsules therein are small and/or few in number. Furthermore, due to the fact that the containers are disposable, the cost is maintained at a minimum when the containers are small in physical size.

Due to the fact that the medicine containers are small in physical size a person who receives the medicine may encounter difficulty in grasping and retaining a container for removal of the pills or capsules from the container.

Such a medicine container must be covered in order to maintain the pills and capsules within the container and to keep the pills and capsules clean.

It is an object of this invention to provide a medicine container for pills, capsules and the like in which the container is small in physical size but which is easily grasped and retained by a person as the pills and capsules are dispensed from the container.

It is another object of this invention to provide such a medicine container which includes a cover member which seals the container and which is easily removable from the container by a person for dispensing the medicine from the container.

Other objects and advantages of this invention reside in the construction of parts, the combination thereof, the method of production and the mode of use, as will become more apparent from the following description.

SUMMARY OF THE INVENTION

A medicine container of this invention comprises a small box-like member which includes a rigid bottom wall, a pair of rigid side walls and a pair of rigid end walls. The side and end walls form an opening through which medicine, such as pills and capsules, enter the container and through which the pills and capsules are dispensed from the container. A flange is integral with the end walls and side walls and extends from the opening and from the end walls and from the side walls and is substantially normal to the end walls and side walls.

The side walls have curved or waved portions which are readily grasped by a person's fingers. A portion of each of the end walls has a relatively flat surface which is at an angle with respect to the side walls. Preferably, the flat surfaces of the end walls are substantially parallel one with respect to the other. Also, preferably, the flat surfaces of the end walls are at an angle of between fifteen (15) and seventy-five (75) degrees with respect to the side walls. Therefore, a person can readily and easily grasp and retain the container as the person's fingers engage any two or more of the walls.

The container of this invention includes a cover member. The cover member comprises a plurality of layers of paper or paper-like material. A top layer of the cover member has a lower surface which is coated with releasable adhesive material. Adhesively attached to the lower surface of the top layer is an attachment layer. The attachment layer has an annular portion which has generally the same dimensions and configuration as the flange which encompasses the opening in the container.

The annular portion of the attachment layer has a lower surface which is coated with a bonding type of adhesive. The annular portion of the attachment layer is thus secured to the flange by means of the bonding type of adhesive. Also, attached to the top layer is a pair of spaced-apart tab parts which extend from the flange which encompasses the opening in the container.

Attached to the top layer and encompassed by the annular portion of the attachment layer is a lid layer which covers the opening in the container. The lid layer has a shape substantially the same as the shape of the opening in the container and extends between the side walls and end walls. However, the lid layer has a plurality of protuberant parts which rest upon the flange which encompasses the opening in the container.

When it is desired to open the container, two or more of the walls of the container are grasped by a person's thumb and one or two fingers. Then one of the tab parts of the top layer is grasped and the top layer is lifted from the attachment layer. The attachment layer remains adhesively attached to the flange of the container as the top layer is released from the attachment layer. The lid layer which is adhesively attached to the top layer is moved from the opening in the container as the top layer is released from the attachment layer.

DETAILED DESCRIPTION OF THE PREFERRED EMBODIMENT

Figures 1, 2, 3, 4, 5, 6:
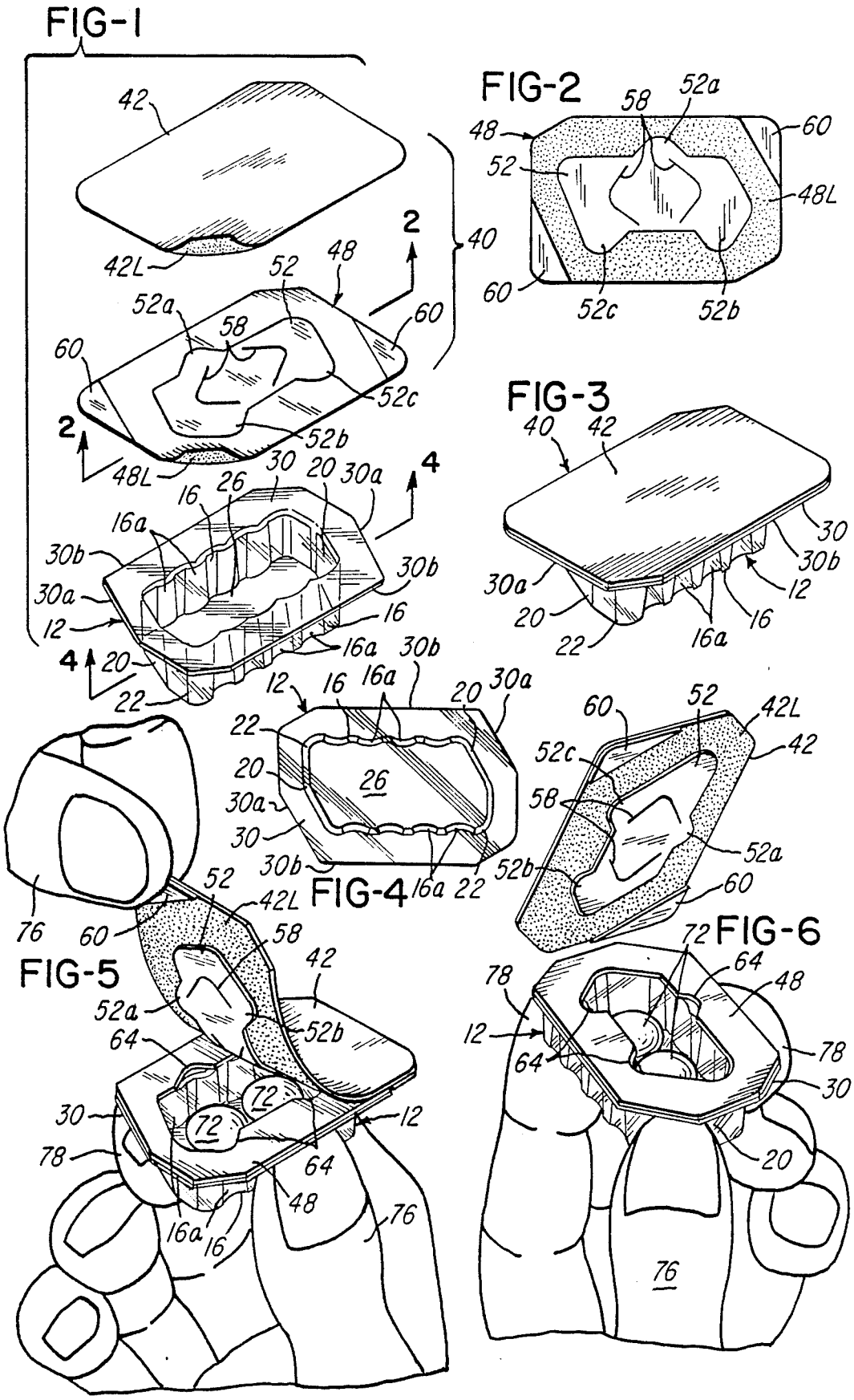
FIG. 1 is an exploded perspective view of a medicine container and cover therefor, constructed in accordance with this invention.
FIG. 2 is a bottom view, taken substantially on line 2—2 of FIG. 1.
FIG. 3 is a perspective top view showing the container of FIG. 1 with the cover attached to the container.
FIG. 4 is a bottom view of the container, taken substantially on line 4—4 of FIG. 1.
FIG. 5 is a perspective view illustrating the procedure of opening the container by removal of a major portion of the cover. This figure also illustrates the manner in which the container may be grasped during opening of the container.
FIG. 6 is a perspective view showing the container in an open condition and showing a major portion of the cover removed from the container. This view also illustrates another method by which the container may be grasped during opening thereof.

A container 12 of this invention is shown as a small disposable box-like member which is adapted to contain medicine, such as pills, capsules and the like. The container 12 comprises a pair of side walls 16. Each of the side walls 16 has a plurality of wave portions 16*a*. The container 12 also comprises a pair of relatively straight end walls 20 which are joined to the side walls 16 by curved walls 22. Preferably, the end walls 20 are substantially parallel, one with respect to the other. The end walls 20 are shown as being at an angle of approximately thirty (30) or sixty (60) degrees with respect to the side walls 16. However, the end walls 20 may be at any angle with respect to the side walls 16. Preferably, the end walls 20 are at an angle of between fifteen (15) degrees and seventy-five (75) degrees with respect to the side walls 16.

Joined to the walls 16, 20, and 22 is a bottom wall 26. The walls 16, 20, and 22 and the bottom wall 26 are of rigid material, such as a plastics material or the like. Extending laterally from the walls 16, 20, and 22 at the upper portions thereof is a flange 30. The flange 30 is annular and has edge portions 30*a* which are substantially parallel to the end walls 20. The flange 30 is shown as having generally a constant width around the container 12. The flange 30 has side edges 30*b* which are substantially parallel to the side walls 16.

A cover member 40 of paper or paper-like material encloses the container 12. The cover member 40 includes a top layer 42, which has a lower surface 42L which is coated with a releasable adhesive material. The cover member 40 also includes an annular attachment layer 48 which has dimensions and a configuration which are generally the same as the dimensions and configuration of the flange 30 of the container 12. The attachment layer 48 has a lower surface 48L which is coated with a bonding adhesive.

Adhesively attached to the top layer 42 and extending through the attachment layer 48 is a lid layer 52. The lid layer 52 is not attached to the attachment layer 48 but is closely encompassed by the annular attachment layer 48. The lid layer 52 has protuberant portions 52*a*, 52*b*, and 52*c* at the periphery of the lid layer 52. The lid layer 52 is shown as having a pair of curved cuts 58 therein, for a purpose discussed below.

Also, adhesively attached to the top layer 42 are tabs 60. The tabs 60 are at opposed portions of the top layer 42. The lower surface 48L of the attachment layer 48 is adhesively bonded to the flange 30 of the container 12. When the attachment layer 48 is secured to the flange 30 the tabs 60 are adjacent the edges 30*a* of the flange 30 and extend therefrom.

When the cover 40 is upon the container 12, the lid layer 52 encloses the opening in the container 12 which is formed by the walls 16, 20, and 22. The annular attachment layer 48 has recesses 64 above the surface of the flange 30. As the annular attachment layer 48 is secured to the flange 30 and as the lid layer 52 encloses the opening in the container 12, the protuberances 52*a*, 52*b*, and 52*c* of the lid layer 52 are positioned within the recesses 64 of the annular attachment layer 48 and the protuberances 52*a*, 52*b*, and 52*c* lie upon the flange 30.

Shown within the container 12 in FIGS. 5 and 6 is medicine in the form of pills 72. When it is desired to dispense the pills 72 from the container 12, the side walls 16 of the container 12 may be engaged by a person's thumb 76 and fingers 78, as illustrated in FIG. 5. Due to the fact that the side walls 16 include the waves 16*a*, the side walls 16 are readily and easily grasped for firmly retaining the container 12. Also, if desired for dispensing the pills 72, the end walls 20 may be engaged by a person's thumb 76 and fingers 78 as illustrated in FIG. 6. Also, if desired, any one or more of the walls 16 and 20 may be grasped for firmly retaining the container 12 for dispensing the pills 72 from the container 12.

Due to the fact that the tabs 60 extend from the edges 30*a* of the flange 30, either of the tabs 60 can be easily grasped. For uncovering the container 12, one of the tabs 60 is grasped, as illustrated in FIG. 5, and the top layer 42 is released and lifted from the attachment layer 48. The attachment layer 48, which is sealingly adhesively attached to the flange 30 remains attached to the flange 30. With the top layer 42, the lid layer 52 is lifted from the container 12, as illustrated in FIGS. 5 and 6. The curved cuts 58 in the lid layer 52 permit the lid layer 52 to be readily flexed and aid in removing the lid layer 52 from the container 12 with removal of the top layer 42 from the attachment layer 52. Thus, the container 12 is opened, and the contents thereof can be removed from the container 12.

Figure 7:
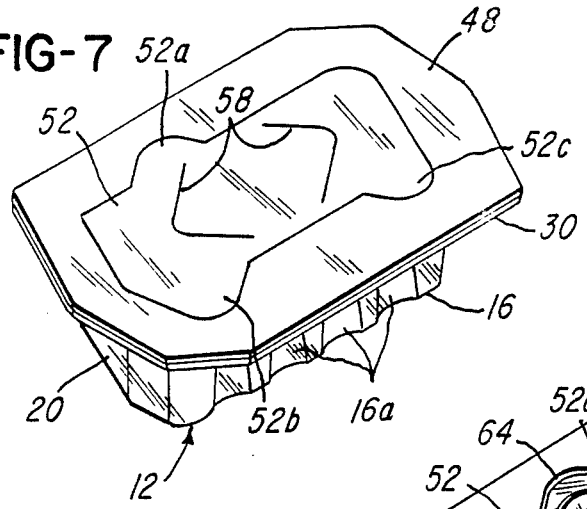
FIG. 7 is a perspective view which shows a container of this invention with the major portion of the cover removed and showing a condition in which the lid layer of the cover fails to release from the container and remains in enclosing relationship over the opening of the container.

As stated above, the attachment layer 48 and the lid layer 52 are attached to the top layer 42 by a releasable adhesive. In some instances, the lid layer 52 does not release from the container 12 as the top layer 42 is lifted from the attachment layer 48 and from the container 12. Thus, in such situations the lid layer 52 remains in closing relationship to the container 12 as shown in FIG. 7.

Figure 8:
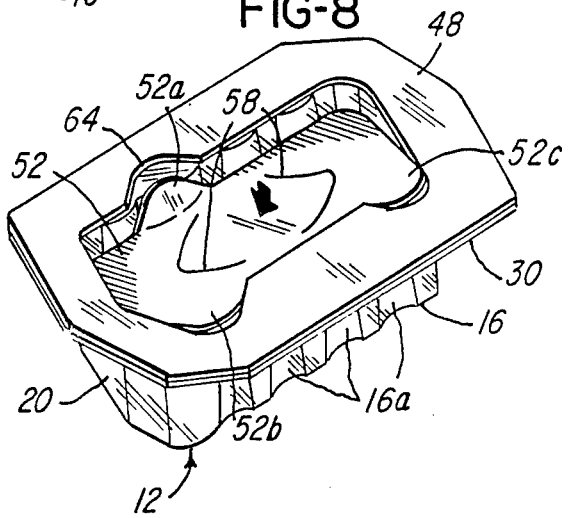
FIG. 8 is a perspective view which illustrates a procedure by which the lid layer of the cover is removed from the container when the lid layer fails to release from the container with the major portion of the cover.

When this situation occurs, a problem in opening the container 12 might exist. However, the lid layer 52 can be easily removed from the container 12 by forcing an edge portion of the lid layer 52 downwardly into the container 12, as illustrated in FIG. 8. As shown in FIG. 8, the edge portion of the lid layer 52 having the protuberance 52*a* is forced downwardly into the container 12. When this occurs, the edge of the lid layer 52 which has the protuberances 52*b* and 52*c* is pivoted upwardly due to the fact that the protuberances 52*b* and 52*c* are resting upon the flange 30. This pivotal action is illustrated in FIG. 8. When this occurs, either the protuberance 52*b* or 52*c* can be grasped and the lid layer 52 is then easily removed from the container 12.

Figure 9:
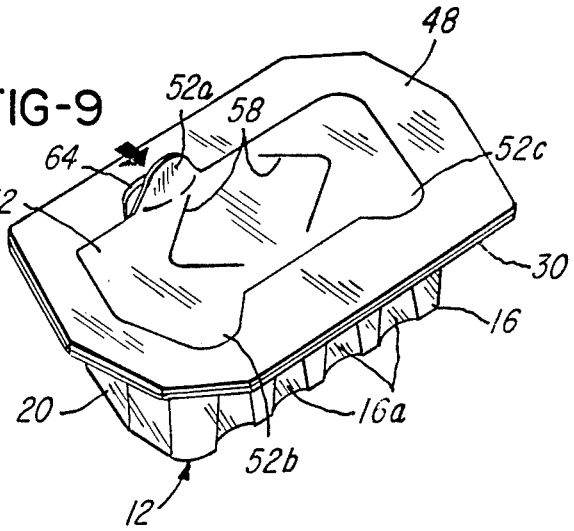
FIG. 9 is a perspective view which illustrates another procedure by which the lid layer of the cover is removed from the container when the lid layer fails to release from the container with the major portion of the cover.

If the lid layer 52 fails to release from the container 12 when the top layer 42 is released from the attachment layer 48, there is another method of removal of the lid layer 52. This alternative method of removing the lid layer 52 from the container 12 is illustrated in FIG. 9. One of the protuberances 52*a*, 52*b*, or 52*c*, herein shown as the protuberance 52*a*, is lifted from the attachment layer 48 and from the flange 30 and grasped. Thus, the lid layer 52 is easily removed from the container 12.

Thus, it is understood that the medicine container 12 of this invention has the cover member 40 which is sealingly attached to the flange 30. Therefore, the contents of the container 12 are sealed and maintained in a clean condition. The container 12 can be easily opened for dispensing the contents thereof. The container 12 can be readily grasped and firmly retained by a person for dispensing the contents of the container 12. A tab 60 which extends from the end walls 20 can be readily grasped. Then the top layer 42 of the cover member 40 is readily removed from the container 12 for dispensing the contents of the container 12. When the top layer 42 is removed from the attachment layer 48, the attachment layer 48 remains firmly secured to the flange 30.

Thus, evidence is provided against the possibility of tampering with the contents of the container 12.

If the lid layer 52 should inadvertently remain upon the container 12 after removal of the top layer 42, the lid layer 52 can be easily removed from the container 12.

Although the preferred embodiment of the medicine container and cover therefor of this invention has been described, it will be understood that within the purview of this invention various changes may be made in the form, details, proportion and arrangement of parts, the combination thereof, and the mode of use, which generally stated consist in a structure and a method within the scope of the appended claims.

The invention having thus been described, the following is claimed:

1. A medicine container comprising a small box-like body which includes a bottom wall, a pair of side walls, each of the side walls including a wave formation portion, a pair of end walls, each of the end walls including a substantially straight portion which is angular with respect to the side walls, and a flange integral with the side walls and end walls and extending laterally therefrom.

2. The medicine container of claim 1 in which the straight portions of the end walls are substantially parallel one with respect to the other and in which the angular relationship between the straight portions of the end walls and the side walls is between fifteen degrees and seventy-five degrees.

3. The medicine container of claim 1 in which the flange has an edge portion which is substantially parallel to the straight portion of an end wall.

4. The medicine container of claim 1 in which each of the walls comprises rigid material.

5. The medicine container of claim 1 in which the flange has an edge portion which is substantially parallel to the straight portion of an end wall and spaced therefrom and which includes a cover member which includes a tab element, the cover member being adhesively attached to the flange of the container adjacent the edge portion of the flange, whereby the tab can be readily grasped for removal of the cover from the container.

6. The medicine container of claim 1 in which the flange is annular and encompasses the side walls and the end walls of the container and has a substantially constant width dimension as it encompasses the side walls and end walls of the container.

7. The medicine container of claim 1 which includes a cover member which includes a lid layer and a top layer, the lid layer being attached to the top layer and having a protuberant portion which engages the flange and which can be readily grasped by a person's fingers whereby the lid layer is readily removable from the container.

8. The medicine container of claim 1 which includes a cover member which includes a lid layer which extends between the walls of the container and which encloses the container, the lid layer including a plurality of protuberances which rest upon the flange, whereby the lid layer can be pivoted about one of the protuberances and whereby the lid layer is readily removable from the container.

9. The medicine container of claim 1 which includes a cover member which comprises a top layer and a lid layer and an attachment layer, the attachment layer being annular and attached to the flange, the lid layer being attached to the top layer, the lid layer being encompassed by the attachment layer, the attachment layer being releasably attached to the top layer.

10. The medicine container of claim 1 which the flange is annular and in which the medicine container includes a cover member which comprises a top layer and a lid layer and an attachment layer, the attachment layer being annular and attached to the flange, the attachment layer having generally the same dimensions and configuration as the dimension and configuration of the flange, the attachment layer being adhesively bonded to the flange, the lid layer being attached to the top layer, the lid layer being encompassed by the attachment layer, the top layer being releasably adhesively attached to the attachment layer.

11. A small disposable medicine container which comprises a first pair of rigid enclosure walls which are substantially parallel one with respect to the other and a second pair of rigid enclosure walls which are substantially parallel one with respect to the other, the first pair of enclosure walls being at an angle less than ninety degrees with respect to the second pair of enclosure walls, at least one of the enclosure walls including wave portions, whereby the container can be readily grasped and retained during dispensing of medicine from the container.

12. The small disposable medicine container of claim 11 which includes a flange which is integral with the enclosure walls and which extends laterally therefrom, the medicine container also including a paper-like cover member which includes an attachment layer which is adhesively attached to the flange, the cover member also including a lid layer which is positioned between the enclosure walls and which encloses the container, the cover member also including a top layer which is attached to the lid layer and which is releasably adhesively attached to the attachment layer.

13. The small disposable medicine container of claim 11 in which the first pair of enclosure walls is at an angle of approximately thirty degrees with respect to the second pair of enclosure walls, the medicine container including a flange having a pair of edge portions which are substantially parallel to the second pair of enclosure walls.

14. The small disposable medicine container of claim 11 in which the first pair of enclosure walls is at an angle of approximately thirty degrees with respect to the second pair of enclosure walls, the container including a flange having a pair of edge portions which are substantially parallel to the second pair of enclosure walls, and the medicine container also including a cover member which is provided with a tab which is adjacent an edge portion of the flange and is also adjacent the enclosure wall which is parallel to the edge portion.

15. A small disposable medicine container which comprises a pair of rigid side walls and a pair of rigid end walls, a flange integral with the walls and extending laterally therefrom, a cover member which comprises a plurality of layers, there being a top layer and an attachment layer and a lid layer, the attachment layer being annular and having a configuration generally the same as the configuration of the flange, the attachment layer being secured to the flange, the top layer being releasably adhesively attached to the attachment layer, the lid layer enclosing the container between the walls thereof, the lid layer being encompassed by the attachment layer and attached to the top layer, whereby the top layer and the lid layer are removable from the container for dispensing the contents thereof.

16. The small disposable medicine container of claim 15 in which at least one of the rigid walls includes a wave portion, whereby the container is readily grasped and retained by a person's hand for releasing the top layer of the cover member from the attachment layer and for dispensing the contents of the container.

17. The small disposable medicine container of claim 15 in which the lid layer includes a protuberant portion which rests upon the flange, whereby the protuberant portion serves as a pivot upon the flange for removing the lid layer from the container.

18. The small disposable container of claim 15 in which the lid layer has a curved cut therein for enhancing the flexibility of the lid layer and for removal of the lid layer with removal of the top layer from the container.

19. The small disposable medicine container of claim 15 in which the attachment layer has a recess therein, the lid layer including a protuberant portion which is positioned within the recess of the attachment layer, whereby the protuberant portion of the lid layer rests upon the flange within the recess portion of the attachment layer, and whereby the protuberance of the lid layer serves as a pivot upon the flange to remove the lid layer from the container.

20. A method of producing a small disposable medicine container comprising forming a generally box-like member having a pair of side walls and a pair of end walls, forming a wave portion into at least one of the walls, whereby the wave portion of the wall can be firmly engaged for manually grasping the medicine container and for retaining the medicine container for dispensing the contents of the medicine container.

21. The method of claim 20 which includes forming a flange integrally with the walls and extending laterally therefrom, forming a top cover layer, forming an annular attachment layer, attaching the annular attachment layer to the flange of the container, forming a lid layer, positioning the lid layer within the annular attachment layer whereby the lid layer is encompassed by the annular attachment layer, attaching the annular attachment layer and the lid layer to the top cover layer, whereby the top cover layer is releasable from the attachment layer and the lid layer is removable from the container with removal of the top cover layer from the attachment layer.

22. The method of claim 20 which includes forming a flange integrally with the walls and extending laterally therefrom, forming a top cover layer, forming an annular attachment layer, attaching the annular attachment layer to the flange of the container, forming a lid layer, positioning the lid layer within the annular attachment layer whereby the lid layer is encompassed by the annular attachment layer, attaching the lid layer to the top cover layer, releasably attaching the annular attachment layer to the top cover layer, whereby the top cover layer is releasable from the attachment layer and the lid layer is removable from the container with removal of the top cover layer from the attachment layer.

23. The method of claim 20 in which the pair of end walls is formed at an angle of between fifteen degrees and seventy-five degrees with respect to the side walls.

24. The method of claim 20 which includes forming a flange integrally with the end walls and side walls and extending laterally therefrom, forming a top cover layer, forming an annular attachment layer, forming a recess in the annular attachment layer, attaching the annular attachment layer to the flange of the container, forming a lid layer having a protuberance, positioning the lid layer within the annular attachment layer whereby the lid layer is encompassed by the annular attachment layer and whereby the protuberance of the lid layer is positioned within the recess of the annular attachment layer, positioning the protuberance of the lid layer upon the flange, releasably attaching the annular attachment layer and the lid layer to the top cover layer, whereby the top cover layer is releasable from the attachment layer and the lid layer is removable from the container with movement of the top cover layer from the attachment layer, and whereby the lid layer is also removable from the container by pivotal movement of the protuberance of the lid layer upon the flange.

25. The method of claim 20 which includes forming a flange integrally with the end walls and side walls and extending laterally therefrom, forming a top cover layer, forming an annular attachment layer, attaching the annular attachment layer to the flange of the container, forming a lid layer having a protuberance, positioning the lid layer within the annular attachment layer whereby the lid layer is encompassed by the annular attachment layer, positioning the protuberance of the lid layer upon the flange, releasably attaching the annular attachment layer and the lid layer to the top cover layer, whereby the top cover layer is releasable from the attachment layer and the lid layer is removable from the container with movement of the top cover layer from the attachment layer, and whereby the lid layer is also removable from the container by manually grasping the protuberance of the lid layer.

26. The method of claim 20 which includes forming a flange integrally with the end walls and side walls and extending laterally therefrom, forming a top cover layer, forming an annular attachment layer, forming a recess in the annular attachment layer, attaching the annular attachment layer to the flange of the container, forming a lid layer having a protuberance, positioning the lid layer within the annular attachment layer whereby the lid layer is encompassed by the annular attachment layer, and positioning the protuberance of the lid layer within the recess of the annular attachment layer, releasably attaching the annular attachment layer and the lid layer to the top cover layer, whereby the top cover layer is releasable from the attachment layer and the lid layer is removable from the container with movement of the top cover layer from the attachment layer, and whereby the lid layer is also removable from the container by manually grasping the protuberance of the lid layer.

* * * * *